US008820557B2

(12) United States Patent
Parks, Jr. et al.

(10) Patent No.: US 8,820,557 B2
(45) Date of Patent: Sep. 2, 2014

(54) DUAL MODE FUNNEL MEMBER

(75) Inventors: Clayton Parks, Jr., Linden, MI (US); Patrick E. Mulry, Alto, MI (US)

(73) Assignee: Bar's Products, Inc., Holly, MI (US)

( * ) Notice: Subject to any disclaimer, the term of this patent is extended or adjusted under 35 U.S.C. 154(b) by 436 days.

(21) Appl. No.: 13/348,155

(22) Filed: Jan. 11, 2012

(65) Prior Publication Data

US 2013/0175237 A1 Jul. 11, 2013

(51) Int. Cl.
*B65D 23/12* (2006.01)
*B65D 88/26* (2006.01)

(52) U.S. Cl.
CPC ..... *B65D 88/26* (2013.01); *B65D 2231/007* (2013.01)
USPC ..... 215/386; 215/250; 215/306; 220/212; 220/254.3; 220/265; 220/375; 222/461; 222/566

(58) Field of Classification Search
CPC ..... B65D 88/26; B65D 2231/007; B65D 2517/0049; B65D 83/16
USPC ..... 222/461, 462, 460, 566; 215/386, 250, 215/306, 274; 220/212, 254.1, 254.3, 319, 220/265, 375
See application file for complete search history.

(56) References Cited

U.S. PATENT DOCUMENTS

| | | | | |
|---|---|---|---|---|
| 3,372,846 | A | 3/1968 | Berkus | |
| 4,132,225 | A * | 1/1979 | Whattam | 600/576 |
| 4,274,555 | A * | 6/1981 | Sneider | 222/107 |
| 4,572,386 | A | 2/1986 | Marcus | |
| 5,065,913 | A * | 11/1991 | Glasener | 222/528 |
| 5,088,613 | A * | 2/1992 | Dutt et al. | 215/250 |
| 6,264,072 | B1 * | 7/2001 | Johannes | 222/460 |
| 6,484,905 | B1 * | 11/2002 | Swackhamer et al. | 222/158 |
| 8,118,198 | B1 * | 2/2012 | Watson | 222/462 |

* cited by examiner

*Primary Examiner* — Robert J Hicks
*Assistant Examiner* — Kareen Rush
(74) *Attorney, Agent, or Firm* — Gifford, Krass, Sprinkle, Anderson & Citkowski, P.C.

(57) ABSTRACT

A bottle has a funnel member defining a pouring spout attached thereto by a retainer which allows the spout to rotate relative to the bottle. The funnel member retains the spout in a storage/transport mode wherein it is affixed to the exterior of the bottle and in a use mode in which the spout is attached to the neck of the bottle so as to facilitate transfer of a fluid.

12 Claims, 5 Drawing Sheets

DUAL MODE FUNNEL MEMBER

FIELD OF THE INVENTION

This invention relates, in general, to containers for storing and dispensing liquids. More particularly, the invention relates to containers having an attached pouring funnel which may be selectably disposed in a storage position in which it is separate from the contents of the container or a use position in which it operates to transfer the contents of the container.

BACKGROUND OF THE INVENTION

A large number of products are provided to consumers in the form of liquids. Transfer of liquid products to points of use or alternative storage locations can require the use of a transfer device such as a funnel or pouring spout, particularly in those instances where the fluid is viscous and/or access to the point of use is difficult. For the sake of convenience, funnels, spouts, and the like are often included along with containers of fluids. In some instances, fluids may be supplied in containers which include an integral funnel or spout; however, while such approaches are convenient for relatively small volume containers, presence of an integral spout or the like complicates storage, transport, and packaging of even moderate volumes of fluid. In other instances, prior art containers are provided with retractable spouts which, in a storage position, are retained within the container in contact with the fluid. The use of containers of this type can raise problems of spillage and contamination, particularly when the fluids involved are viscous and/or non-aqueous, such as is the case with automotive products and the like.

As will be explained in detail hereinbelow, the present invention provides a bottle assembly which includes a pouring spout which is attached to the exterior of the bottle so that when the package is being shipped or stored, the spout is not in contact with the fluid. In the use of the package of the present invention, the spout is readily connected to the bottle for dispensing of the fluid without requiring removal of the assembly from the bottle. Packages in accord with the present invention are easy to ship and use which makes the products contained therein attractive to both retailers and customers. These and other advantages of the invention will be apparent from the drawings, discussion, and description which follow.

BRIEF DESCRIPTION OF THE INVENTION

Disclosed is a bottle assembly having a funnel member attached thereto. The funnel member comprises a pouring spout which is engageable with the neck of the bottle so as to define a fluid channel in communication with the interior of the bottle. The funnel member also includes a retainer which engages the bottle, and a first and a second attachment segment join the spout to the retainer. The funnel member functions in a first, storage/transport mode in which the spout is not engaged with the neck of the bottle. In this first mode, the spout is joined to the bottle by the retainer via at least one of the first and second attachment portions. The funnel member also functions in a second, use mode in which the spout is engaged with the neck of the bottle so as to allow for transfer of the fluid therefrom. In this mode, the spout is also attached to the bottle by the retainer via at least one of the attachment portions.

In some particular instances, the funnel member is configured so that the second attachment portion includes a segment having a weaker tear strength than does the first attachment portion. In this embodiment, the spout may be partially freed from the retainer by tearing the second attachment portion so as to facilitate the engagement of the spout with the neck of the bottle, while the spout is still retained by the first attachment portion.

In particular instances, the funnel member is comprised of a unitary body of a polymeric material such as an olefin polymer. The retainer portion may be configured so as to allow for rotation of the spout portion relative to the bottle so as to facilitate its engagement with the neck of the bottle.

DETAILED DESCRIPTION OF THE INVENTION

The present invention comprises an assembly having a bottle with a funnel member attached thereto. The funnel member provides a pouring spout which can be attached to the bottle. It is a notable feature of the present invention that the funnel member is configured to remain attached to the bottle when it is in both a storage/transport mode and a use mode. In the storage/transport mode, the spout portion is retained on the exterior surface of the bottle so as to not be in contact with the fluid retained in the interior of the bottle. When the funnel member is in the use mode, the spout is attached to the neck of the bottle so as to provide a fluid channel in communication with the fluid in the interior of the bottle. The funnel member is configured so that the spout may be attached to the bottle without detaching it from its attachment point to the exterior of the bottle.

It is to be understood that the system of the present invention may be implemented in a number of embodiments; and for purposes of discussion, one particular embodiment is illustrated herein. Other embodiments will be readily apparent to those of skill in the art and are included within the scope of this invention.

Figure 1:
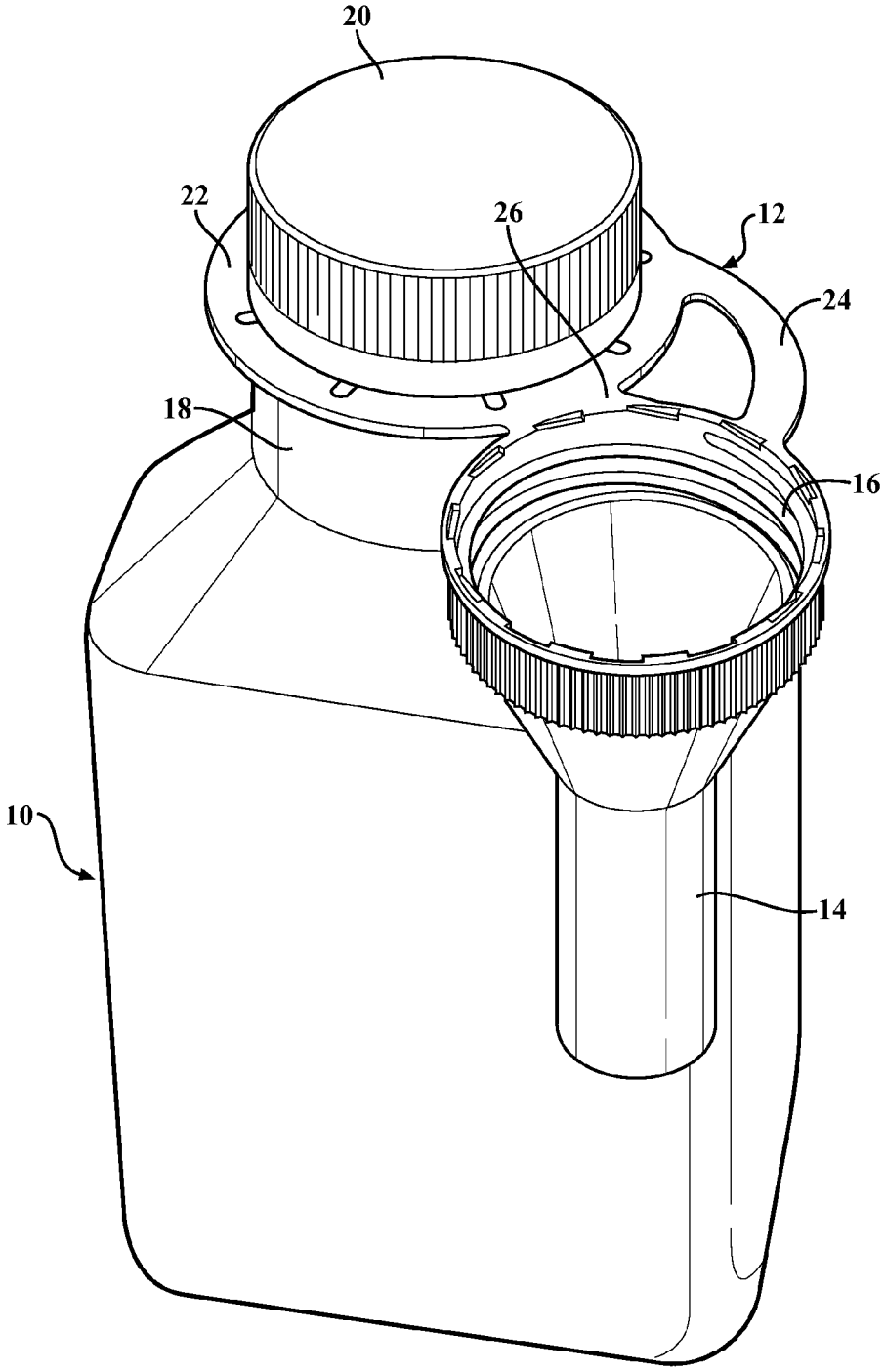
FIG. 1 is a perspective view of a bottle assembly of the present invention showing the funnel member as disposed in a storage/transport mode.

Referring now to FIG. 1, there is shown a perspective view of an assembly comprising a fluid-containing bottle 10 having a funnel assembly 12 of the present invention affixed thereto. As will be seen, the funnel assembly 12 includes a pouring spout 14 which includes screw threads 16 defined thereupon. These screw threads 16 function to couple the spout 14 to the neck 18 of the bottle 10 when the cap 20 is removed therefrom.

As will be seen, the spout 14 is coupled to a retainer 22 which engages the neck 18 of the bottle 10. As shown, the spout 14 is attached to the retainer 22 by a first attachment portion 24 and a second attachment portion 26. In this embodiment, the second attachment portion 26 is a tearable portion having a segment with a tear strength which is less than the tear strength of the first portion 24.

Figure 2:
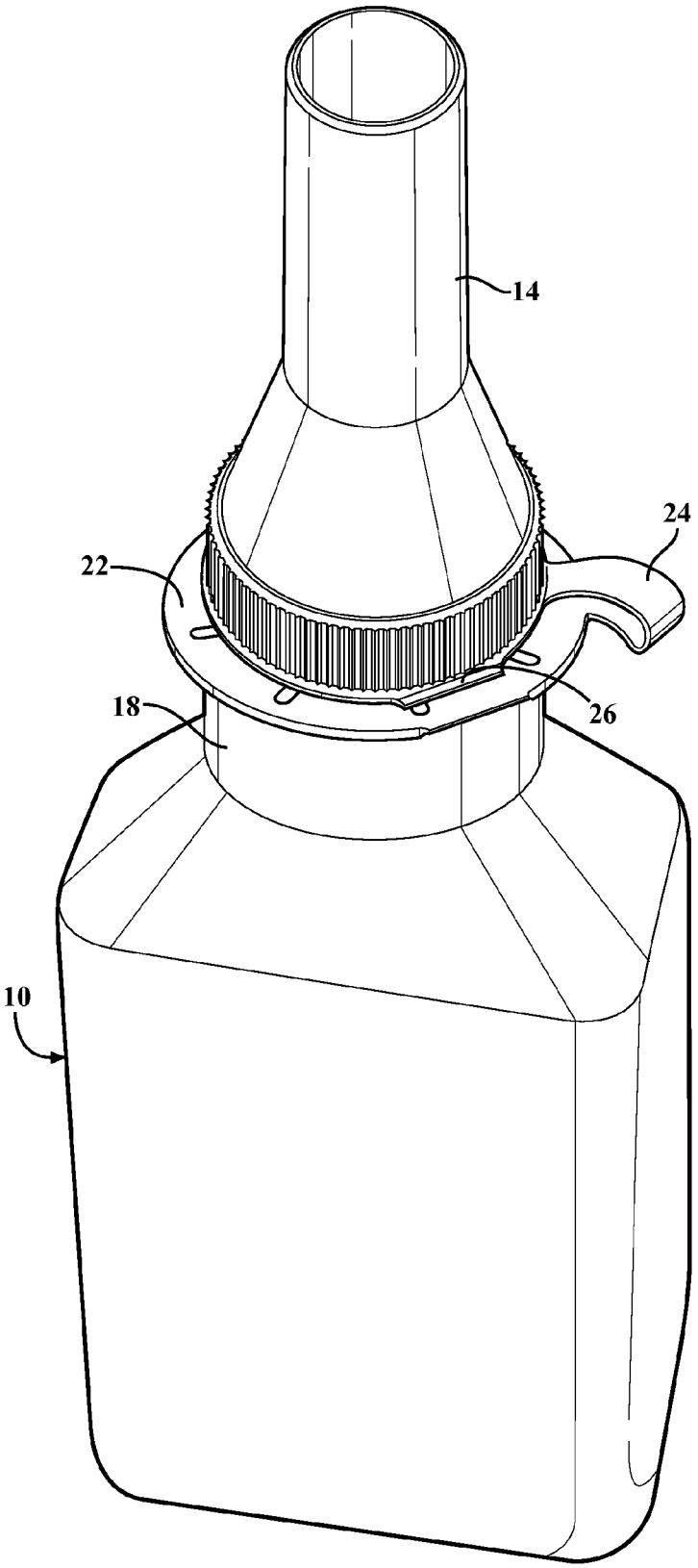
FIG. 2 is a perspective view of the bottle assembly of the present invention showing the funnel member as deployed in a use mode.

Referring now to FIG. 2, there is shown a perspective view of the assembly of FIG. 1 wherein the spout has been deployed in its use mode wherein it functions to transfer fluid from the container to an endpoint. As will be seen, the second attachment portion 26 has been torn at its junction point with the retainer 22, leaving the spout 14 still attached to the retainer by its first attachment portion 24. The cap has been removed from the bottle 10, and the spout 14 has been screwed into engagement with the neck 18 of the bottle 10. In accord with the present invention, the retainer 22 engages the neck of the bottle 18 so as to permit rotation of the spout 14 relative to the bottle, thereby facilitating connection.

The assembly of the present invention is particularly useful for transferring motor vehicle fluids such as oils, fuel treatments, cooling system products, hydraulic products, and the like to a motor vehicle. The fact that the spout 14 is stored separate from the fluid prevents spillage and contamination and simplifies the transfer process. The fact that the spout 14 remains attached to the container 10 before, during, and after the transfer of fluid is significant since it prevents loss of the spout in the event that only a partial transfer of the fluid takes place.

The fact that the system of the present invention employs a dual attachment of the spout to the retainer via one permanent and one breakable connection is also significant since, in the instance where both connections are intact, the spout is retained in very rigid and tight engagement with the package thereby facilitating storage, shipping, display, and sale of the product; whereas when the attachment portion is broken, the spout is retained in a much looser connection with the retainer thereby facilitating its connection to the container. It is to be understood that while this feature is significant, in particular instances other embodiments of the present invention may connect the spout to the retainer by one or more nontearable attachment portions.

Figure 3:
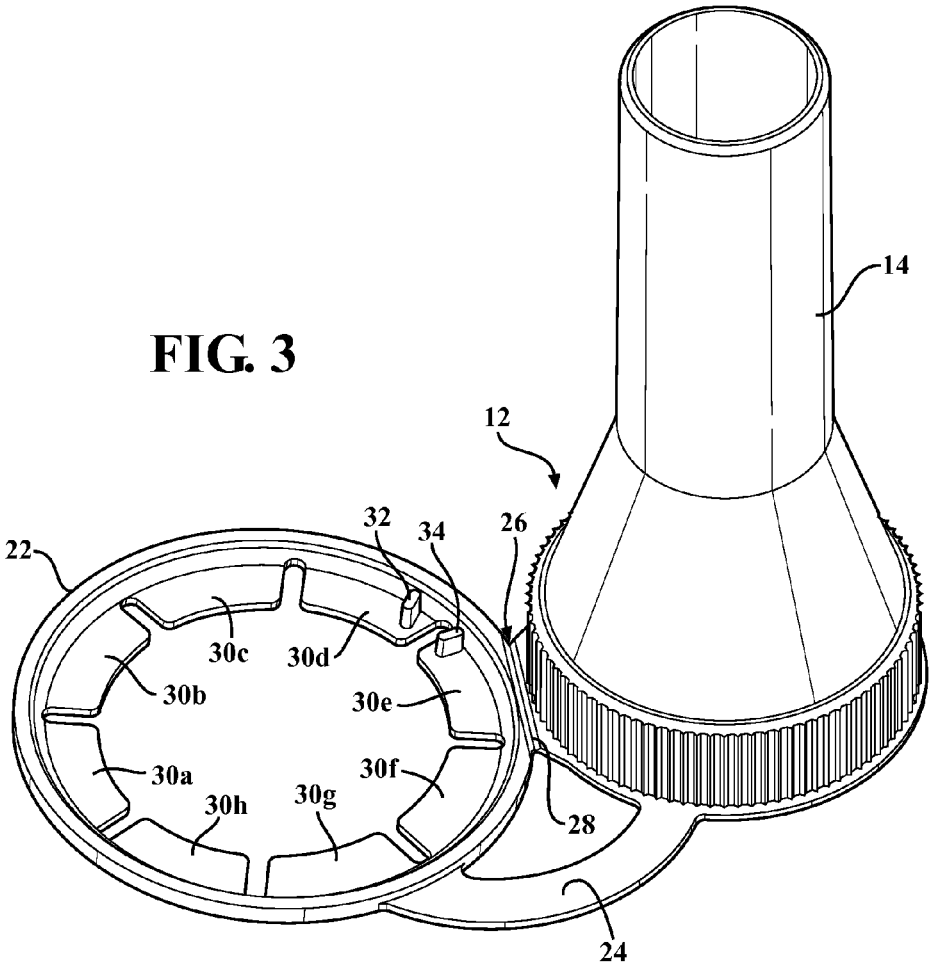
FIG. 3 is a perspective view of a funnel member of the present invention.
Figure 4:
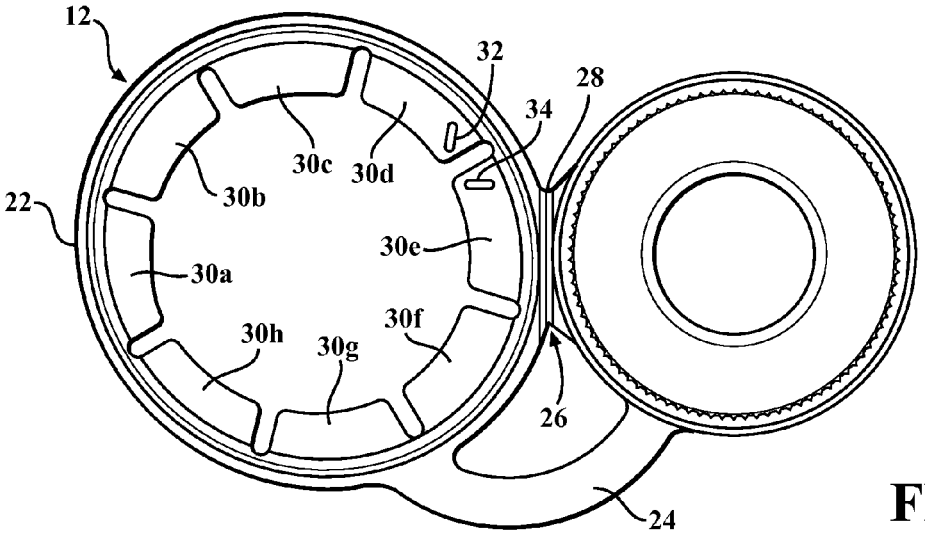
FIG. 4 is a top plan view of the funnel member of FIG. 3.

FIG. 3, shows a perspective view of the funnel member 12 of FIGS. 1 and 2, and FIG. 4 shows a top plan view of the funnel member 12. As will be seen from FIGS. 3 and 4, the second attachment portion 26 includes a groove 28 defined therein. This groove serves to decrease the tear strength of the second attachment portion 26 relative to the tear strength of the first attachment portion 24. It is to be understood that such weakening may likewise be accomplished by the use of perforations or other geometric features or by alteration of the material properties of the attachment portion itself.

As will also be seen from FIGS. 3 and 4, the retainer 22 is in this instance configured as a ring which encircles the neck of the bottle, and this ring includes a plurality of detent tabs 30*a*-30*h* projecting radially inward from the ring portion. The detent tabs are flexible and serve to maintain the retainer in engagement with the neck of the bottle. In most instances bottle necks are molded so as to include a raised circumferential rim, and these detent members snap over that raised portion and thereby function to maintain the retainer in engagement with the bottle neck while still permitting the retainer and associated components of the funnel member to rotate relative to the bottle. This rotation facilitates connection of the spout 14 as discussed above, and the groove 28 in the second attachment portion 26 as well as the detent tabs 30*a*-30*g* will be noted.

As will be further noted from FIGS. 3 and 4, the retainer 22 may include one or more orientation lugs 32, 34 defined thereupon. When the cap 20 is screwed onto the bottle 10 the orientation lugs 32, 34 are pushed into contact with the shoulder of the bottle 10 so as to prevent the retainer 22 from rotating relative to the bottle 10. This serves to maintain the orientation of the funnel assembly 12 relative to the bottle 10 during shipping, display and sale. Removal of the cap 20 allows the funnel assembly to rotate thereby facilitating attachment.

Figure 5:
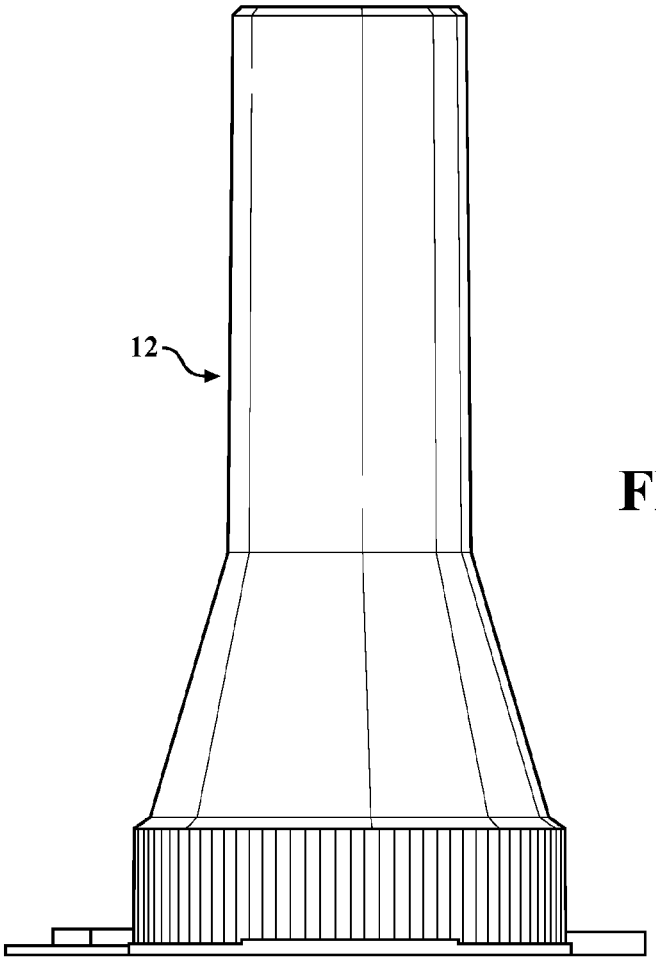
FIG. 5 is a front elevation view of the funnel member of FIG. 3.
Figure 6:
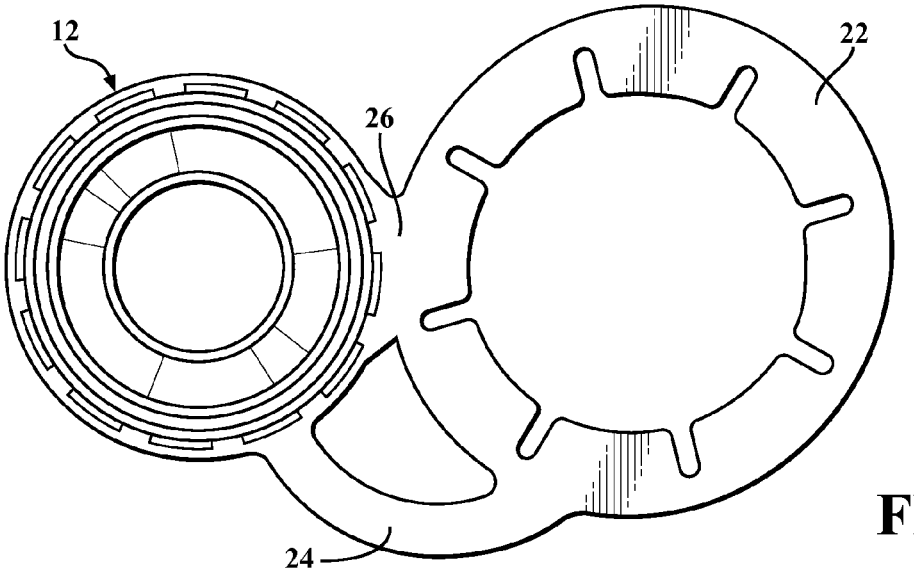
FIG. 6 is a bottom plan view of the funnel member of FIG. 3.

FIG. 5 is a front elevation view of the funnel assembly 12, and FIG. 6 is a bottom plan view of the assembly 12.

Figure 7:
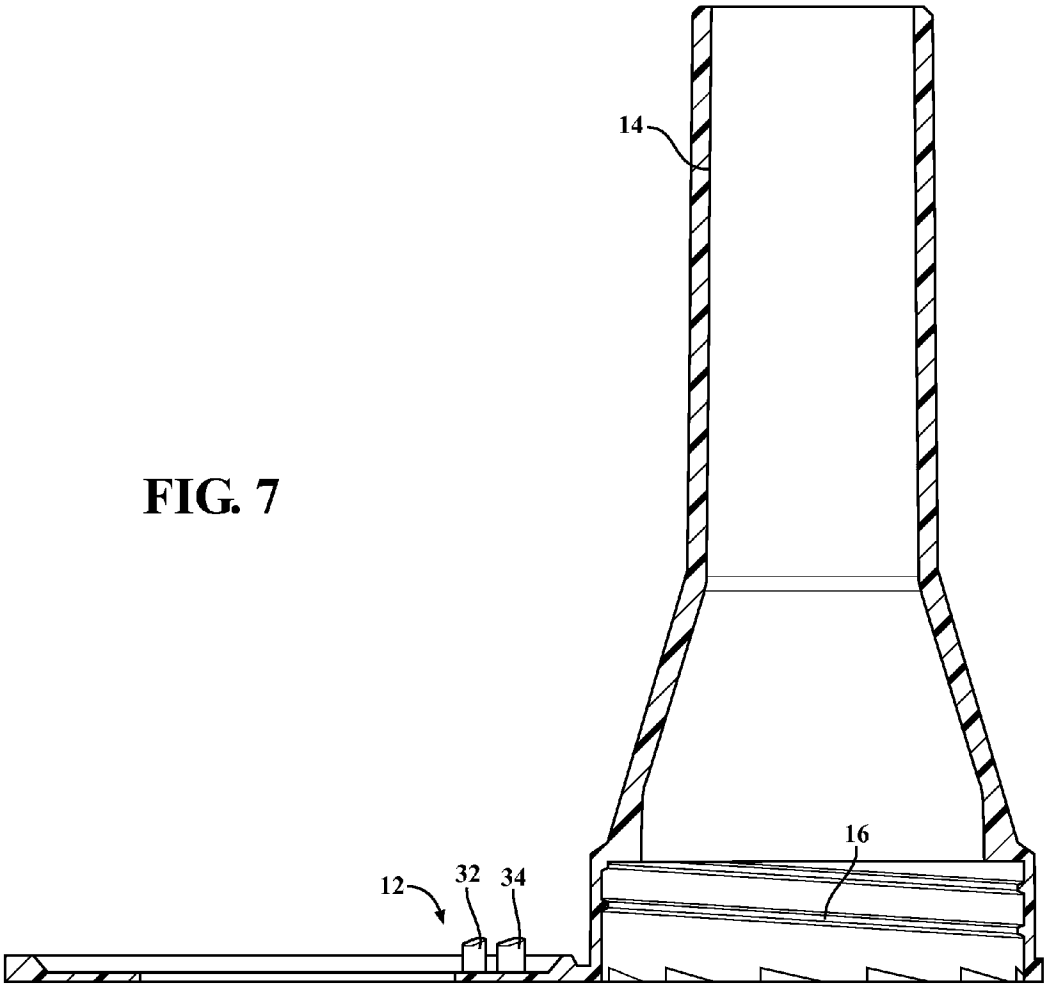
FIG. 7 is a cross-sectional view of the funnel member of FIG. 3.

Referring now to FIG. 7, there is shown a cross-sectional view of the funnel member 12. As will be seen, the spout portion 14 has a hollow interior which defines a fluid flow channel which, when the spout member 14 is affixed to the bottle, will be in communication with the interior of the volume. Also visible in FIG. 7 are the orientation lugs 32, 34. As will be noted from FIG. 7, a series of screw threads 16 are defined on the spout portion and will function to couple the spout portion to the bottle. It is to be understood that other types of couplers including flanges, tabs, and the like may be incorporated into the present invention.

The funnel member of the present invention is, in particular instances, fabricated from a unitary body of polymeric material. This may be accomplished readily by molding processes as is known in the art. Some particular materials used to fabricate this member comprise polyolefin polymers such as polyethylene, polypropylene, and the like.

It should be noted that, as illustrated, the spout portion of the funnel member is a fairly straight spout having a slight taper. It is to be understood that other design configurations of spout may be likewise implemented. For example, particular embodiments may include a longer spout or a curved spout as dictated by design aesthetics and/or functionality. Also, it is to be understood that certain automobile manufacturers have very particular configurations of fuel tank filler necks which are engageable only by specifically configured spouts. In those instances where the present invention is adapted for introducing fluids into tanks having such particular filler necks, the spout may be accordingly configured.

It is to be understood that in view of the teaching presented herein, numerous modifications and variations of the invention may be readily implemented by those of skill in the art. The foregoing drawings, discussion, and description are illustrative of some specific embodiments but are not meant to be limitations upon the practice of the invention. It is the following claims, including all equivalents, which define the scope of the invention.

The invention claimed is:

1. A bottle assembly having a funnel member attached thereto, said assembly comprising:

a bottle, configured to retain a liquid in the interior thereof, said bottle including a neck portion having an opening defined therein in communication with the interior of said bottle;

a funnel member comprising:

a pouring spout which is engageable with the neck of said bottle so as to define a fluid flow channel in communication with the interior of said bottle;

a retainer which engages said bottle;

a first attachment portion and a second attachment portion separate from said first attachment portion, said attachment portions joining said spout to said retainer;

wherein said funnel member is configured to be operable in a first, storage mode wherein said spout is not engaged with the neck of said bottle and is retained upon said bottle by said retainer via at least one of said first and second attachment portions; and in a second, use mode in which said spout is engaged with the neck of the bottle and is retained upon said bottle by said retainer via at least one of said first and second attachment portions.

2. The bottle assembly of claim 1, wherein said second attachment portion includes a segment which has a tear strength which is less than the tear strength of said first attachment portion and wherein when said funnel member is operable in said use mode, said spout is retained upon said bottle by said retainer via only said first attachment portion.

3. The bottle assembly of claim 1, wherein said retainer rotatably engages the neck of said bottle so as to permit said spout to be rotated relative to said neck.

4. The bottle assembly of claim 1, wherein said funnel member comprises a unitary body of a polymeric material.

5. The bottle assembly of claim 4, wherein said polymeric material is a polyolefin.

6. The bottle assembly of claim 1, wherein said retainer includes a plurality of detent tabs formed thereupon which maintain said retainer in engagement with the neck of said bottle.

7. The bottle assembly of claim 1, wherein the neck of said bottle includes a first coupling feature and the spout includes a second coupling feature which is engageable with the first coupling feature wherein said first and second coupling features cooperate to couple the spout to the neck of the bottle.

8. A funnel assembly which is attachable to a bottle, said funnel assembly comprising:

a pouring spout which defines a fluid flow channel;

a retainer which is attachable to a bottle;

a first attachment portion which joins said spout to said retainer, said first attachment portion having a first tear strength; and a second attachment portion which joins said spout to said retainer, said second attachment portion including a segment which has a tear strength which is less than the tear strength of said first attachment portion.

9. The funnel assembly of claim 8, wherein said funnel assembly comprises a unitary body of a polymeric material.

10. The funnel assembly of claim 8, wherein said retainer comprises a ring.

11. The funnel assembly of claim 10, wherein said retainer includes a plurality of detent tabs projecting radially inward from the circumference of said ring.

12. The funnel assembly of claim 8, wherein said retainer includes at least one orientation lug defined thereupon.

* * * * *